US005944898A

United States Patent [19]

Mendez

[11] Patent Number: 5,944,898

[45] Date of Patent: Aug. 31, 1999

[54] APPARATUS FOR SUCCESSIVE APPLICATION OF TWO COATS OF LIQUID OR PASTY MEDIUM ON ONE SIDE OF A TRAVELING WEB OF MATERIAL

[75] Inventor: Benjamin Mendez, Heidenheim, Germany

[73] Assignee: Voith Sulzer Papiermaschinen GmbH, Heidenheim, Germany

[21] Appl. No.: 08/873,663

[22] Filed: Jun. 12, 1997

[30] Foreign Application Priority Data

Jun. 13, 1996 [DE] Germany ..... 296 10 395 U

[51] Int. Cl.[6] ..... B05C 1/00

[52] U.S. Cl. ..... 118/641; 118/642; 118/643; 118/58; 118/67; 118/68; 118/224; 118/249; 118/255; 118/261; 118/410; 118/413; 118/419

[58] Field of Search ..... 118/46, 620, 641–643, 118/58, 67, 68, 224, 249, 255, 261, 410, 413, 419; 427/382, 428, 209, 211; 101/178, 424.4; 162/135

[56] References Cited

U.S. PATENT DOCUMENTS

| | | | |
|---|---|---|---|
| 2,645,201 | 7/1953 | Muggleton | 118/227 |
| 3,308,751 | 3/1967 | Hata | 101/178 |
| 3,611,919 | 10/1971 | Thomas | 101/178 |
| 4,277,524 | 7/1981 | Nakajima et al. | 118/67 |
| 4,980,207 | 12/1990 | Sollinger | 427/402 |
| 5,101,760 | 4/1992 | Sollinger | 118/410 |
| 5,340,611 | 8/1994 | Kustermann et al. | 427/361 |

FOREIGN PATENT DOCUMENTS

| | | | |
|---|---|---|---|
| 0 417 368 A1 | 3/1991 | European Pat. Off. . | |
| 0 609 483 B1 | 7/1997 | European Pat. Off. . | |
| G 91 00 291 U | 5/1991 | Germany . | |
| 40 02 256 A1 | 8/1991 | Germany . | |
| 40 13 776 A1 | 10/1991 | Germany . | |
| 620280 | 7/1978 | U.S.S.R. | 118/249 |
| 2 189 714 | 11/1987 | United Kingdom . | |
| WO 92/00419 | 1/1992 | WIPO . | |

*Primary Examiner*—Laura Edwards
*Attorney, Agent, or Firm*—Taylor & Associates, P.C.

[57] ABSTRACT

An apparatus for successive application of two coats of at least one coating medium on one side of a traveling fiber material web includes a rotating backing roll and a first rotating applicator roll having a roll surface. The first applicator roll and the backing roll define a first press nip therebetween. A first applicator assembly is positioned in association with said roll surface for applying a first coating medium to the roll surface. The first applicator assembly and the first applicator roll conjunctively define a first indirect applicator for applying the first coating medium to a first side of the fiber material web. A first drying apparatus is positioned after the first press nip relative to a direction of travel of the fiber material web. The first drying apparatus is positioned in association with the first side of the material web. A second applicator is positioned after the first drying apparatus relative to the direction of travel of the fiber material web. The second applicator is also positioned in association with the backing roll whereby the traveling fiber material web travels between the second applicator and the backing roll. The second applicator is configured for applying a second coating medium to the first side of the fiber material web.

16 Claims, 9 Drawing Sheets

APPARATUS FOR SUCCESSIVE APPLICATION OF TWO COATS OF LIQUID OR PASTY MEDIUM ON ONE SIDE OF A TRAVELING WEB OF MATERIAL

BACKGROUND OF THE INVENTION

1. Field of the Invention

The present invention relates to an apparatus for successive application of two coats of liquid or pasty medium on one side of a traveling web of material, notably of paper or cardboard.

2. Description of the Related Art

An apparatus of this type is known, e.g., from German Document No. 43 02 437 A1. With this coating system, a first layer of a coating medium is applied with a first applicator on one side of a traveling web of material, and the material web is then passed through an arrangement of drying apparatuses. Next, a second coat of a coating medium is applied with a second applicator on the side of the material web that was previously provided with the first coat, and the material web passes then again through various drying apparatuses. The two applicators are designed such that an applicator nozzle applies the coating medium on the surface of an applicator roll, and the coating medium transfers in a press nip from the surface of the applicator roll to the material web. In both of the two applicators the press nip is formed between an applicator roll and a backing roll, and the material web passes through the press nip. In one embodiment of the prior coating system, a nozzle applicator is associated also with each of the two backing rolls, so that the backing rolls themselves act also as applicator rolls and the back side of the traveling material web can be provided as well with two coats of a coating medium.

This prior coating system, however, requires a large amount of physical space in order to accommodate the two applicators and the pertaining drying apparatuses as well as the pertaining elements for web routing.

SUMMARY OF THE INVENTION

The invention provides an apparatus for successive application of two coats of liquid or pasty medium on one side of a traveling material web, which apparatus includes a comparatively compact and space-saving design.

The invention requires only one rotating backing roll for two applicators. A first indirect applicator including a rotating applicator roll and a first applicator assembly is coordinated with the backing roll. The first applicator assembly is coordinated with the surface of the applicator roll, applying on it a first liquid or pasty medium. The first liquid or pasty medium transfers then from the surface of the applicator roll, in a press nip formed between the backing roll and the applicator roll and traversed by the traveling material web, to the one side of the material web. Coordinated with the same backing roll, behind the first applicator in the traversing direction of the material web, is a second applicator that applies a second coat of a second liquid or pasty medium on the same side of the material web that was previously provided with the first coat of a first liquid or pasty medium. To that end, the traveling material web traverses between the second applicator and the backing roll. A drying apparatus is associated, between the press nips of the first applicator and of the second applicator, with the side of the material web that was previously provided with the first coat of the first liquid or pasty medium.

Resulting from this inventional arrangement is a very compact and space-saving system, since both applicators for application of the two coats on one side of the material web are coordinated with the same backing roll, while the drying apparatus for intermediate drying of the coat applied first coat may be disposed as well near the backing roll. The first and the second liquid or pasty medium applied may be of different consistency or of the same consistency.

In one embodiment of the present invention, the second applicator is designed as an indirect applicator and includes a second rotating applicator roll and a second applicator assembly. The second applicator roll forms with the backing roll a second press nip traversed by the traveling web of material. The second applicator assembly is coordinated with the surface of the second applicator roll, in order to apply on it the second liquid or pasty medium. In this embodiment, the second liquid or pasty medium is transferred, in analogy to the first applicator, from the surface of the second applicator roll, in the second press nip, to the traveling material web.

In a further embodiment of the invention, the second applicator is designed as a direct applicator and includes a second applicator assembly. The second applicator assembly is associated directly with the traveling material web along an application zone, applying the second liquid or pasty medium. The traveling material web is supported along the application zone by the surface of the backing roll.

"Indirect applicator" is to be understood here such that a liquid or pasty medium to be applied is first applied by an applicator assembly on the surface of an applicator roll and transfers from there in a press nip to one side of the traveling material web. "Direct applicator" is to be understood such that the liquid or pasty medium to be applied is applied by an applicator assembly directly, without an intervening applicator roll, on one side of the traveling material web.

The expression "press nip" is to be understood as pertaining to both a nip in which the medium to be applied is pressed by the surface of the applicator roll in the traveling material web, and also a press nip such as given with a so-called "reverse roll coater." In the first case, i.e., with a press nip, the applicator roll rotates in a direction opposite to that of the backing roll, while in the second case, with a "reverse roll coater," the applicator roll rotates equidirectionally with the backing roll. With the "reverse roll coater" the medium to be applied is first applied on the surface of the applicator roll and applied from there, in the nip in which the surfaces of the applicator roll and the backing roll run in opposite directions, on the traveling material web. The medium to be applied, however, is not pressed into the traveling material web in the nip, but merely transferred to the side to be coated.

In yet a further embodiment of the invention, a third applicator assembly is coordinated with the surface of the backing roll, on the approach side before the press nip of the first applicator, in order to apply a third liquid or pasty medium on the surface of the backing roll. This makes it possible to coat also the back side of the material web, i.e., the web side away from the first and second applicators, with a liquid or pasty medium. Insofar, the backing roll acts for the back side of the web as applicator roll, while the applicator roll of the first applicator forms the respective backing roll so as to transfer the third liquid or pasty medium, in the press nip, from the surface of the backing roll to the back side of the material web.

A still further embodiment of the invention is constituted by passing the traveling material web between the first applicator and the second applicator over at least one reversing roll. In other words, the material web travels in this embodiment, between the first applicator and the second applicator, not on the surface of the backing roll, but is after the first applicator lifted off the backing roll, passed over the at least one reversing roll and then passed again to the second applicator, traversing between the second applicator and the surface of the backing roll. This web routing across at least one reversing roll creates a space between the reversing roll and the surface of the backing roll, which space—as will be explained hereafter—may be utilized for further apparatuses.

Provided in another embodiment of the invention is a second drying apparatus which after the press nip of the first applicator is coordinated with the back side of the traveling material web that was provided previously with a coat of the third liquid or pasty medium. Hence, this second drying apparatus is disposed in the space resulting between the back side of the traveling material web proceeding over at least one reversing roll and the surface of the backing roll. This second drying apparatus makes possible an intermediate drying of the coat applied previously by the third applicator on the back side of the web. As will yet be explained, a still further coat of a liquid or pasty medium can then be applied on the back of the web.

Yet another embodiment of the invention consists in providing between the first and second applicators two reversing rolls, for material web routing, and arranging the drying apparatus that is associated with the web side provided by the first applicator with the first coat, in a section of the traveling material web between the two reversing rolls, and arranging the second drying apparatus associated with the web back side after the second reversing roll, in the traversing direction of the material web. The two mentioned drying apparatuses each include at least one dryer. The routing of the traveling material web between the two reversing rolls is substantially vertical, and after the second reversing roll up to the second applicator it is substantially horizontal. Resulting thereof is a compact system, and this latter routing variant has the advantage that in the event of a web break the material web drops down between the dryer, thereby reducing the chance of fire.

In still yet another embodiment, a fourth applicator assembly is coordinated with the backing roll surface, on the approach side before the second applicator, in order to apply a fourth liquid or pasty medium on the surface of the backing roll. Thus, this fourth applicator assembly is disposed as well in the space obtained between the web back side passing over at least one reversing roll and the surface of the backing roll. With the previously mentioned second drying apparatus being used, the fourth applicator assembly can be arranged, e.g., above the second drying apparatus or in a space between the second drying apparatus and the backing roll surface. With such fourth applicator assembly provided, the second applicator is fashioned as an indirect applicator, so that the applicator roll of the second applicator acts then as backing roll—in analogy to the situation with the third applicator. Again, the backing roll with which the fourth applicator assembly is coordinated serves as applicator roll for the fourth liquid or pasty medium, and the medium, once applied by the fourth applicator assembly on the surface of the backing roll, is pressed into the back side of the traveling material web by the roll surface, in the nip formed between the applicator roll of the second applicator and the backing roll. The web back side may have been already provided, as explained above, with one coat of a third liquid or pasty medium and may have undergone an intermediate drying on the second drying apparatus.

The third and fourth liquid or pasty mediums may be of identical or different consistency, and the consistency of the mediums may facultatively be the same as that of the first or second medium.

In another embodiment of the invention, at least one dryer is coordinated with the side of the traveling material web that was provided by the second applicator with the second coat, and at that, in the traversing direction of the material web after the second applicator. Thus, the second coat can be dried here. In yet another embodiment, with the third and/or fourth applicator being used, at least one dryer may be coordinated with the web back side, after the second applicator in the traversing direction of the material web.

In still another embodiment of the invention, the dryers of the two drying apparatuses arranged between the first and second applicators, as well as the dryers following the second applicator, are fashioned as infrared dryers. The result is a very compact and space-saving design. If needed, however, an individual dryer or all of the dryers may be of a different dryer type.

In a suitable embodiment, the first and/or second and/or third and/or fourth applicator is configured as a finish-dosing applicator. Depending on need and suitability, e.g., on the consistency and further parameters of the respective liquid or pasty mediums to be applied, individual or all of the four applicator assemblies may be designed as finish-dosing applicator assemblies. The concrete design of the applicator assemblies depends, for example in the case of the second applicator assembly, of course also on whether the second applicator is to be configured as a direct or indirect applicator. In favorable configurations, the finish-dosing applicator assemblies are designed as doctor-element/pressure-chamber applicators or doctor element/sump applicators. While with the first type the medium is applied from a pressure chamber via a doctor element, the medium is with the latter type applied from a sump with an exposed liquid surface by way of a doctor element. The concrete selection of the suitable applicator assembly depends here also on the geometric position regarding the associated backing roll or applicator roll. The doctor element of the doctor applicator assembly is a profiled or smooth roll doctor, a doctor bar or a doctor blade.

In a further suitable embodiment, the first and/or second and/or third and/or fourth applicator comprises a predosing apparatus and a follow-on finish-dosing apparatus. As explained before, the selection of applicator assembly type suited best for each of the maximally four applicator assemblies depends on numerous factors that need to be allowed for in the selection of each applicator assembly. In various embodiments, the predosing apparatus may be configured as a scoop roll, doctor-element/pressure-chamber applicator assembly or open-jet nozzle applicator assembly or similar. In the case of a doctor-element/pressure-chamber applicator assembly, the doctor element is a profiled or smooth roll doctor, a doctor bar or doctor blade. Depending on its style, the finish-dosing apparatus comprises a doctor blade, doctor bar or a smooth roll doctor.

As addressed already above, the second applicator, e.g., may also be configured as a "reverse roll coater." The second applicator roll rotates then equidirectionally with the backing roll, while with the second applicator roll, e.g., a container with the medium to be applied is then associated, out of which container the applicator roll scoops the medium. If required, the second applicator roll can then be followed additionally by a finish-dosing apparatus.

Each of the maximally four applicator assemblies may thus be selected individually in accordance with the concrete circumstances, from the applicator assembly type known as such and illustrated heretofore. In addition to the finish-dosing applicator assemblies touched upon and the applicator assemblies subdivided in a predosing apparatus and a finish-dosing apparatus, also other comparable applicator assemblies may be used.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
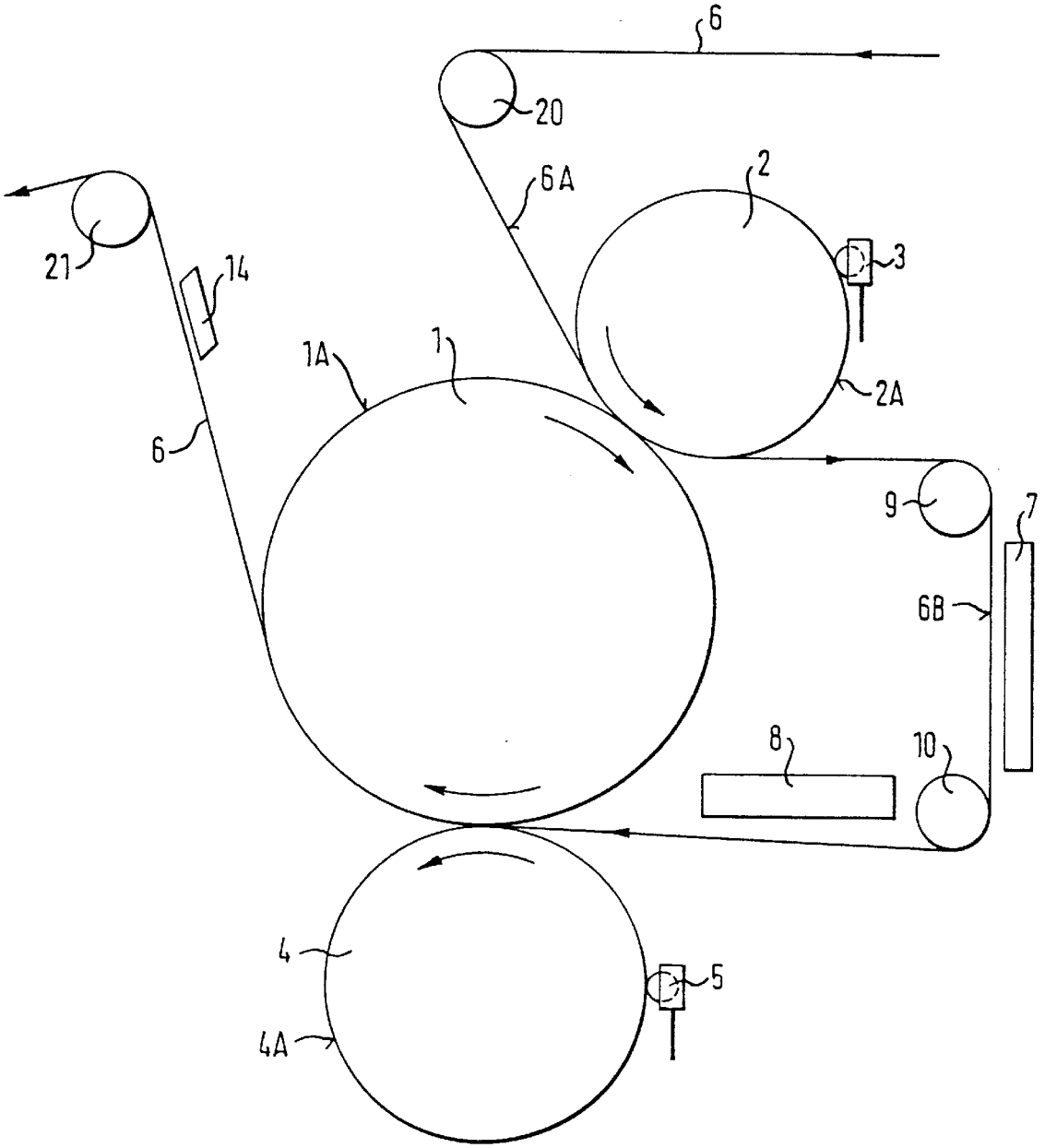
FIG. 1 is a schematic side elevation of a first exemplary embodiment of the apparatus according to the invention.
Figure 2:
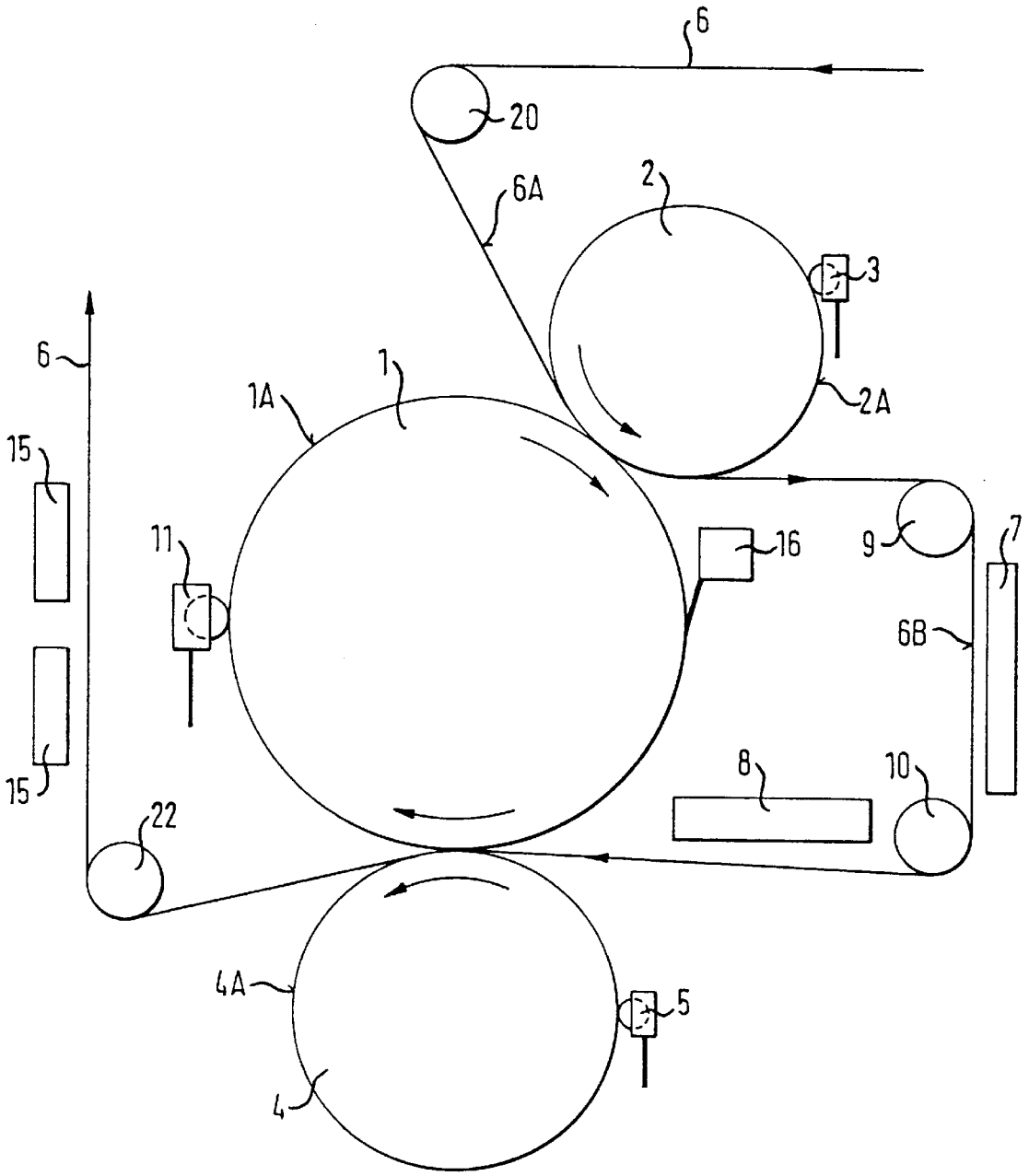
FIG. 2 is a schematic side elevation of a second exemplary embodiment of the apparatus according to the invention.
Figure 3:
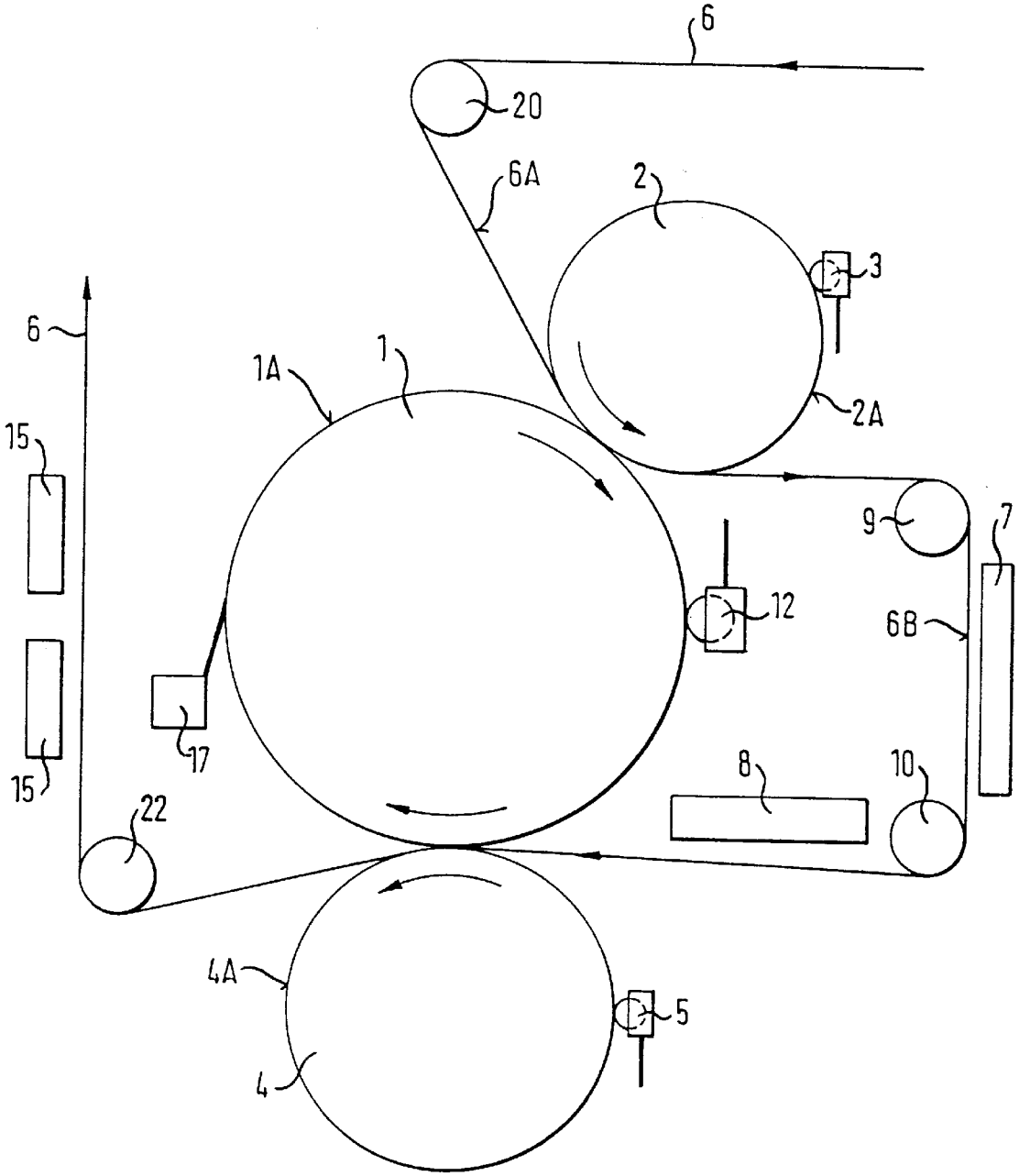
FIG. 3 is a schematic side elevation of a third exemplary embodiment of the apparatus according to the invention.

Referring now to the drawings, there is shown a first backing roll 1 (FIG. 1) rotating in the direction indicated by the arrow, a first applicator roll 2 and a second applicator roll 4. Each of applicator rolls 2 and 4 rotates counter-directionally to backing roll 1. A traveling material web 6, fabricated, for example, of paper, cardboard or a textile material, first deflects over a reversing roll 20 and then passes through a press nip formed between a surface 1A of backing roll 1 and a roll surface 2A of first applicator roll 2. Associated with surface 2A of first applicator roll 2 is a first applicator assembly 3. First applicator assembly 3 is in FIG. 1 indicated merely schematically as a doctor-element applicator assembly. First applicator assembly 3 together with second applicator roll 2 forms a first indirect applicator. Applicator assembly 3 applies a coat of a first liquid or pasty medium on surface 2A of applicator roll 2, and the coat transfers from there, in the press nip formed between applicator roll 2 and backing roll 1, to a web side 6A of traveling material web 6. The nip acts as a press nip serving to press the coating medium in material web 6.

As indicated by the directional arrow, material web 6 proceeds over a reversing roll 9 upon leaving the first nip. Material web 6 is thereby distanced from backing roll 1 after the first nip. Between the first nip and reversing roll 9, material web 6 travels substantially horizontally, and is deflected in a substantially vertically downward direction by reversing roll 9. Thereafter, material web 6 is deflected again in a substantially horizontal direction of travel via a reversing roll 10. A dryer 7, for example an infrared dryer, is coordinated with side 6A of material web 6 between two reversing rolls 9 and 10. Dryer 7 serves the intermediate drying of the first coat of a first liquid or pasty medium applied by first applicator 2, 3 on web side 6A. In the embodiment shown in FIG. 1, in the running direction of reversing roll 10, a further dryer 8, for example an infrared dryer, is associated with a back side 6B of material web 6. Dryer 8 could also be omitted from this embodiment, but it has an intermediate drying function for web back side 6B in the further embodiments explained hereafter.

Upon deflection by reversing roll 10, material web 6 enters a second nip that is formed between a roll surface 4A of second applicator roll 4 and roll surface 1A of backing roll 1. Associated with surface 4A of second applicator roll 4 is a second applicator assembly 5, which is indicated only schematically as a doctor-element applicator assembly. Applicator assembly 5 applies a second coat of a second liquid or pasty medium on surface 4A of second applicator roll 4. From here, the second coat transfers in the second press nip, acting here as a press nip the same as the first nip, on web side 6A of material web 6.

Upon leaving the second press nip, material web 6, while still on surface 1A of backing roll 1, is deflected and runs upward at a slant. Material web 6 is then deflected once again by a reversing roll 21 and proceeds to a further apparatus (not shown) for subsequent treatment of material web 6. In the section of web travel between the second press nip and reversing roll 21, a further dryer 14, for example an infrared dryer, is coordinated with web back side 6B. Dryer 14 may be omitted from this embodiment the same as dryer 8. Dryer 14 is given its function of afterdrying web back side 6B only in the further embodiments explained hereafter.

As evidenced by FIG. 1, the system is very compact and the material web routing is very space-saving. The substantially vertical routing of material web 6 between two reversing rolls 9 and 10 and the web routing underneath dryer 8 minimizes the risk of fire in the event of a web break. Material web 6 would then drop, before dryer 7, down and away from dryer 8, without any chance for material web 6 to rest on one of the hot dryers.

In the embodiment shown in FIG. 1 it is thus possible to apply on the same side 6A of material web 6 a first coat of a coating medium, a so-called precoat, and, after an intermediate drying by dryer 7, a second coat of a coating medium, a so-called finish coat. Applicator assemblies 3 and 5 may be chosen from applicator assemblies known as such for application of a coat on an applicator roll.

In another embodiment (not shown), material web 6 is routed, between the two press nips, directly on surface 1A of backing roll 1. This system is still more compact and two reversing rolls 9 and 10 as well as dryer 8 are dispensable. Dryer 7 could be moved, in FIG. 1 toward the left, closer to backing roll 1.

In the further embodiments, illustrated in FIGS. 2 through 9, identical or corresponding components are referenced the same as in FIG. 1. Therefore, reference is made in that respect to the above explanations on the first embodiment.

In a second embodiment, a third applicator assembly 11 (FIG. 2) is assigned to surface 1A of backing roll 1. Third applicator assembly 11 is indicated schematically as a doctor-element applicator assembly. Third applicator assembly 11 is on the approach side disposed before the first press nip and applies a coat of a third liquid or pasty medium on roll surface 1A. In the first press nip, formed between applicator roll 2 and backing roll 1, the medium is transferred to material web back side 6A and pressed in. Thus, backing roll 1 serves as a backing roll to first applicator roll 2 and as an applicator roll to coat web back side 6B, with first applicator roll 2 acting as a backing roll.

In the space forming between the section of web back side 6B between two reversing rolls 9 and 10 and the section of roll surface 1A between the two press nips, there is a scraping element 16 provided that is coordinated with surface 1A of backing roll 1. Remnants of the third coating medium applied by third applicator assembly 11 are stripped away by scraping element 16. Similar scraping elements may be provided on surfaces 2A and 4A of applicator rolls 2 and 4, respectively on the approach side before applicator assemblies 3 and 5.

Hence, the third applicator assembly enables the application of a coat of a coating medium, a so-called primer coat, on web back side 6B, in addition to the two coats applied successively on web side 6A.

The routing of material web 6 after the second press nip forming between backing roll 1 and applicator roll 4 differs in this embodiment somewhat from the first. Upon leaving the second press nip, material web 6 continues substantially horizontally and is then deflected substantially vertically upward by a reversing roll 22. Material web 6 thus is thereby immediately distanced from surface 1A of backing roll 1, after the second press nip, thus obtaining, as clearly evident in FIG. 2, the necessary space between material web 6 and backing roll 1, for arranging there third applicator assembly 11. After reversing roll 22, a drying apparatus in the form of two dryers 15, for example infrared dryers, is associated with side 6A of material web 6. Dryers 15 serve the afterdrying of the second coat applied previously by second applicator 4, 5.

Dryer 8 now serves the predrying of the coat applied previously on web back side 6B by third applicator assembly 11.

In a third embodiment (FIG. 3), the routing of material web 6 equals that of the second embodiment (FIG. 2), for which reason reference is made to the pertaining explanations. Provided instead of third applicator assembly 11 (FIG. 2) is now an applicator assembly 12 in a fourth applicator assembly position. Applicator assembly 12 is indicated schematically as a doctor-element applicator assembly and is associated with surface 1A of backing roll 1, in the section between the first and second press nips. The space gained between two reversing rolls 9 and 10 and backing roll 1, to back side 6B of web 6, is utilized now for accommodating the further applicator assembly 12. Instead of scraping element 16 (FIG. 2), a scraping element 17 is now provided on the departure side, after the second press nip, and coordinated with roll surface 1A.

Applicator assembly 12 serves in this embodiment, the application of a coat on web back side 6B. Analogous to applicator assembly 11 in FIG. 2, backing roll 1 is utilized by applicator assembly 12 as an applicator roll, and the coat applied is pressed into material web 6 in the second press nip. To press the coat in web back side 6B, applicator roll 4 acts here also analogously as a backing roll. Dryer 8 can be omitted in this embodiment, whereas dryer 14 (FIG. 1) may be coordinated additionally with web back side 6B after reversing roll 22, in order to dry the coat applied previously by applicator assembly 12.

In a fourth embodiment (FIG. 4), two applicator assemblies 11 and 12 are provided in combination. Third applicator assembly 11 serves to apply a coat of a third liquid or pasty medium on web back side 6B, i.e., to apply a precoat on the web back side. This precoat undergoes then an intermediate drying in passing dryer 8. Fourth applicator assembly 12 serves to apply a coat of a fourth liquid or pasty medium on web back side 6B. Hence, a finish coat is applied with fourth applicator assembly 12 on web back side 6B, on the precoat after its intermediate drying at dryer 8. After the second nip forming between backing roll 1 and applicator roll 4 a dryer for web back side 6B could additionally be provided. Such a dryer could be provided either before reversing roll 22 or in the subsequent section of web travel. Such a dryer would then correspond to dryer 14 as indicated in FIG. 1.

Figure 4:
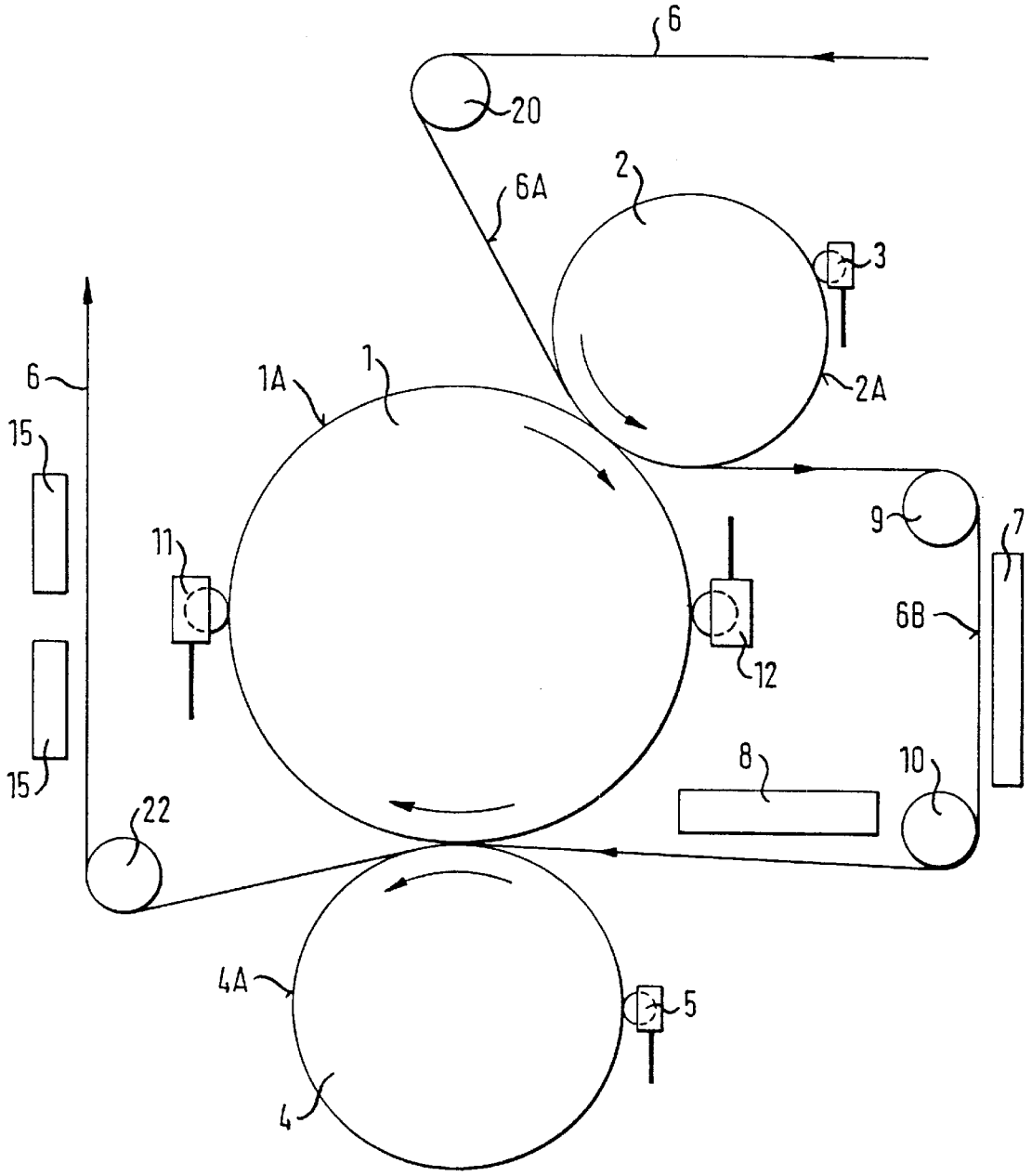
FIG. 4 is a schematic side elevation of a fourth exemplary embodiment of the apparatus according to the invention.

In the fourth embodiment relative to FIG. 4, a precoat and a finish coat of coating medium can thus be applied simultaneously on both web sides 6A, 6B with a very compact and space-saving system. The four liquid or pasty mediums applied by the four applicator assemblies 3, 5, 11 and 12 may each be of different consistency or the same consistency.

In the four embodiments discussed above, relative to FIGS. 1 through 4, the second applicator is an indirect applicator 4, 5. Hence, an applicator assembly 5 is provided here that applies the liquid or pasty medium indirectly, that is, by means of an applicator roll, on material web 6.

A further indirect applicator could be constituted, e.g., by providing an applicator roll which, instead of applicator roll 4, rotates equidirectionally with backing roll 1, forming with it a press nip. The surface of the applicator roll would then run in the press nip counterdirectionally to surface 1A of backing roll 1. Coordinated with this applicator roll may then be as an applicator assembly, instead of the doctor-element applicator assembly shown in the preceding embodiments, a scoop roll which scoops the medium to be applied out of a container. In this described arrangement, the medium to be applied is thus scooped from the container by the surface of the scoop roll, applied on the surface of the applicator roll rotating counterdirectionally to the scoop roll, and is transferred from the applicator roll surface counterdirectionally on the pertaining material web side. Such an indirect applicator (not shown) is called a "reverse roll coater," since the surface of the applicator roll runs in the press nip counterdirectionally to the backing roll surface.

In the following embodiments illustrated in FIG. 5 through 9, the second applicator is respectively provided as a direct applicator. Here, applicator assembly 5 thus applies the medium directly, i.e., without the intermediary of an applicator roll, on the traveling material web 6. With respect to identical or corresponding components as in the preceding embodiments, reference is made to the preceding explanations.

A finish-dosing applicator assembly 5 (FIG. 5) is coordinated with backing roll 1 as a second applicator. Material web 6 is in the region of the application zone of applicator assembly 5 supported by surface 1A of backing roll 1. The finish-dosing applicator assembly that applies the medium by means of a doctor element is a so-called "short dwell applicator." In the embodiment relative to FIG. 5, dryer 14 and dryer 8 could be omitted. Similarly, two reversing rolls 9 and 10 could be omitted and dryer 7 moved closer to backing roll 1, with material web 6 then being routed between first applicator roll 2 and applicator assembly 5, on surface 1A of backing roll 1.

Figure 5:
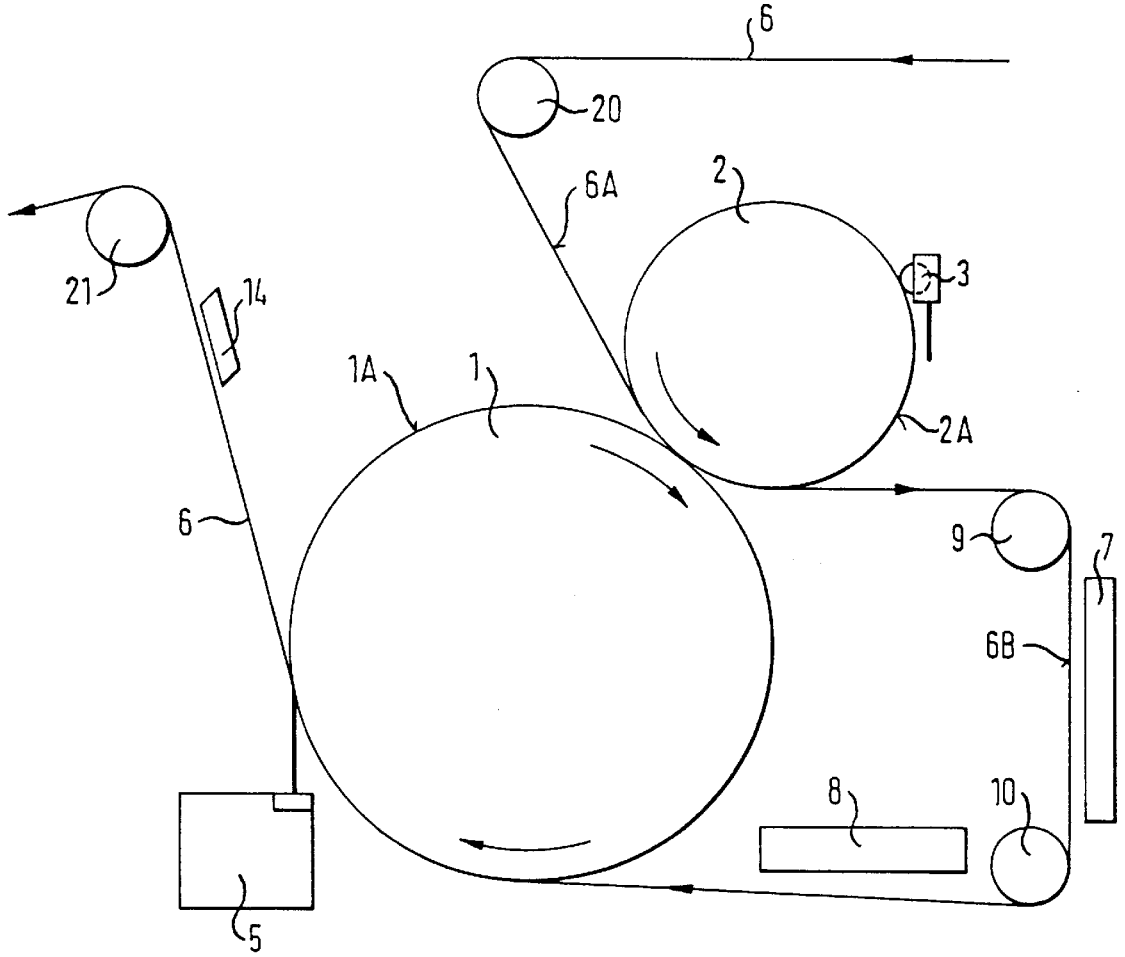
FIG. 5 is a schematic side elevation of a fifth exemplary embodiment of the apparatus according to the invention.
Figure 6:
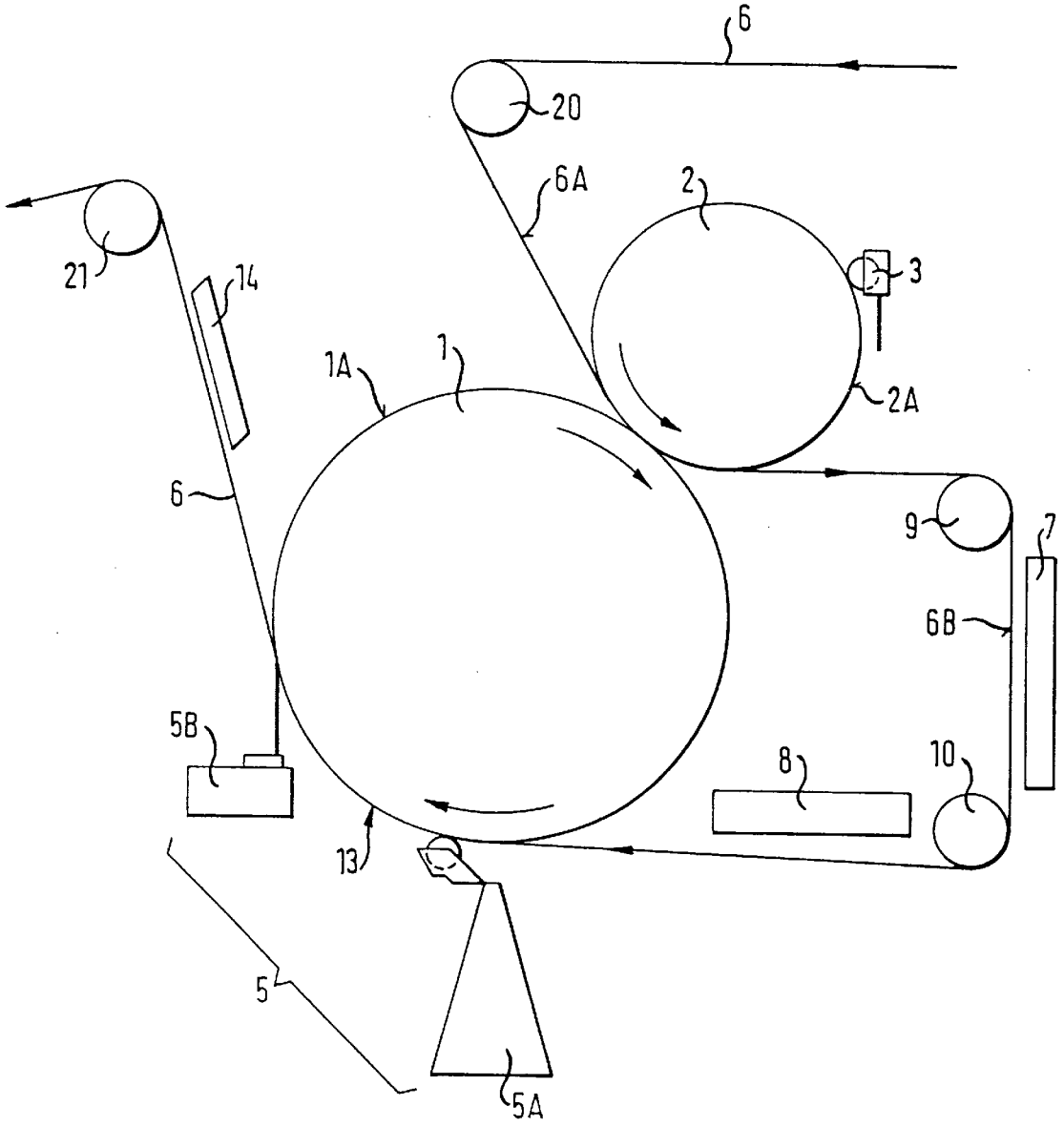
FIG. 6 is a schematic side elevation of a sixth exemplary embodiment of the apparatus according to the invention.
Figure 7:
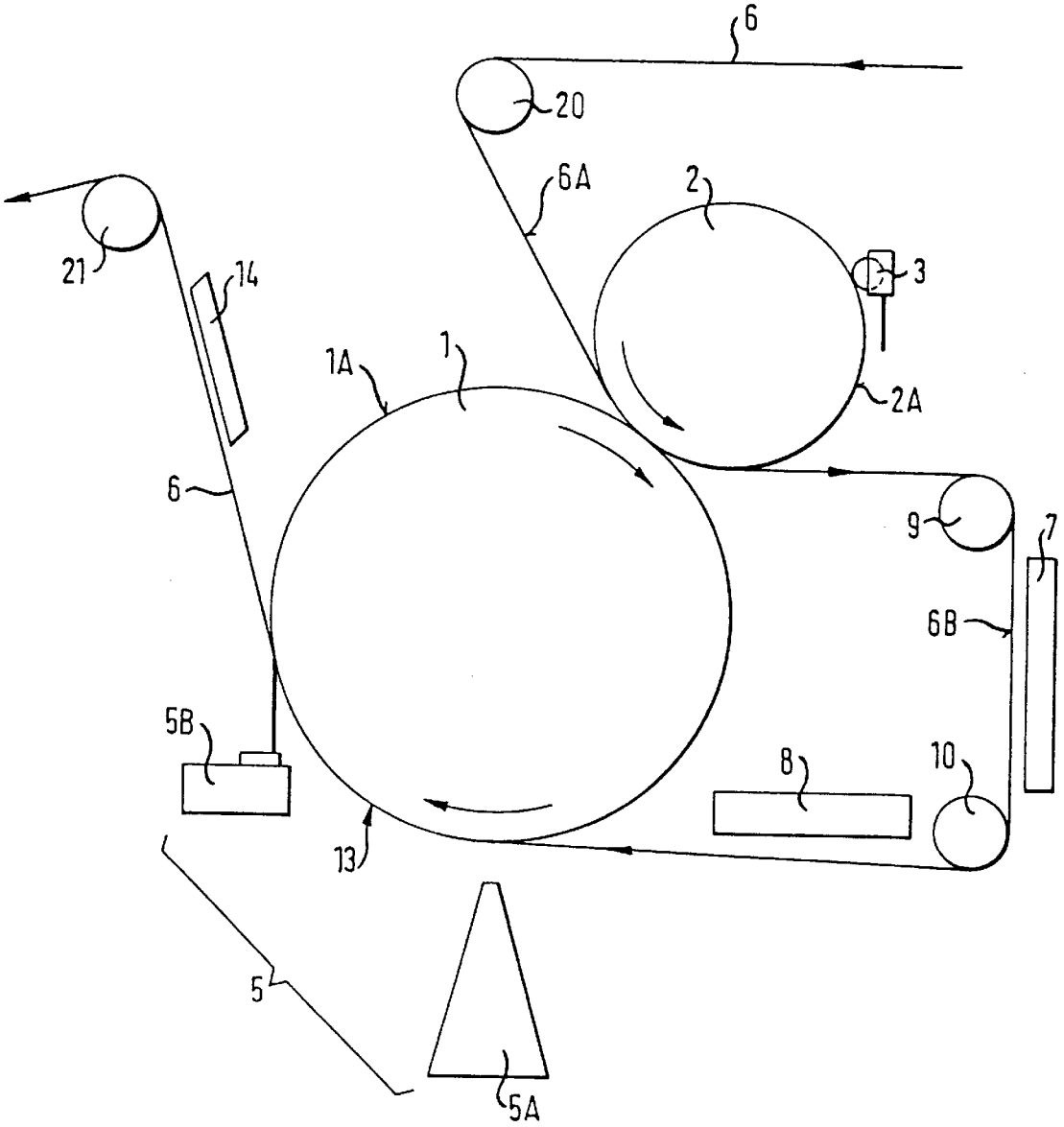
FIG. 7 is a schematic side elevation of a seventh exemplary embodiment of the apparatus according to the invention.
Figure 8:
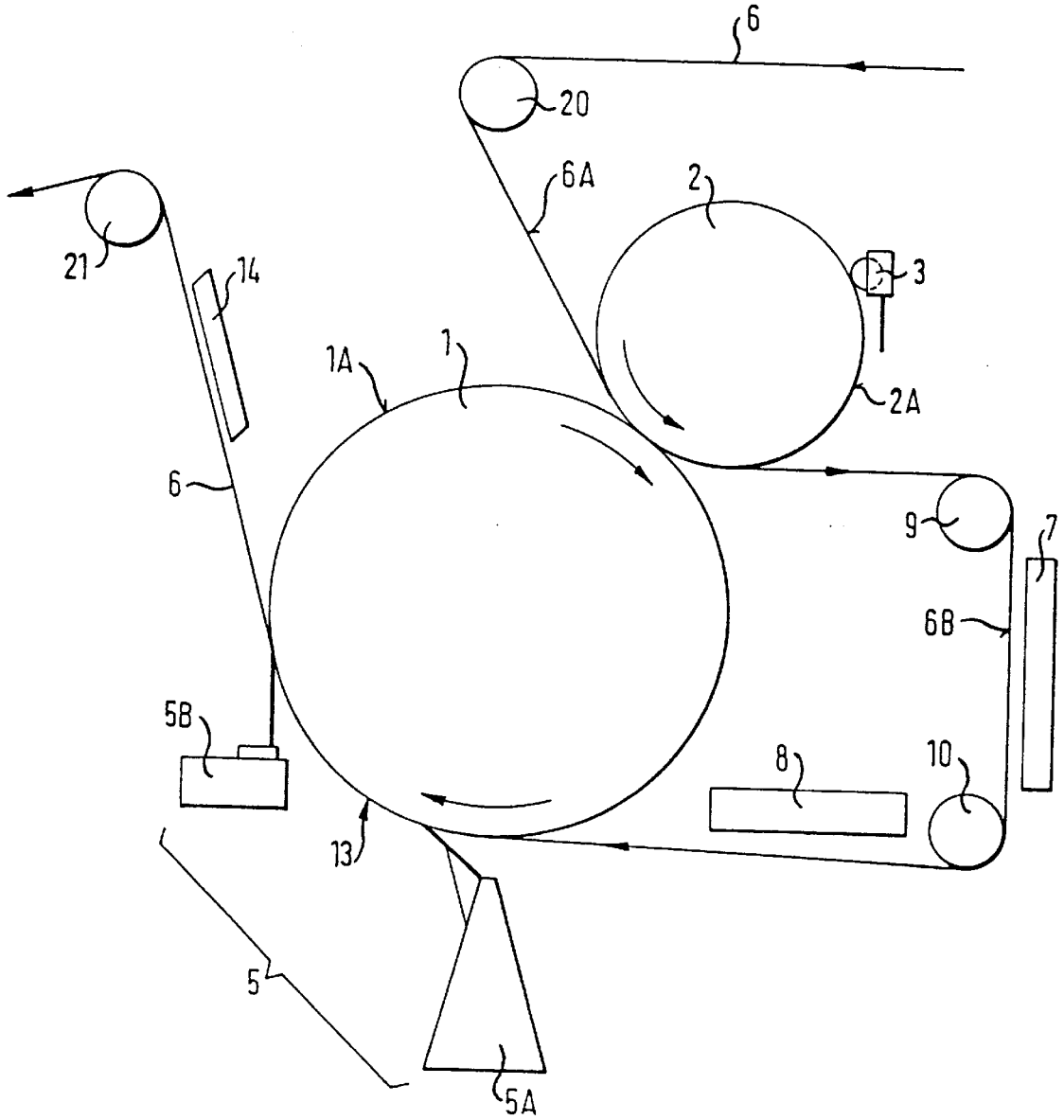
FIG. 8 is a schematic side elevation of an eighth exemplary embodiment of the apparatus according to the invention.
Figure 9:
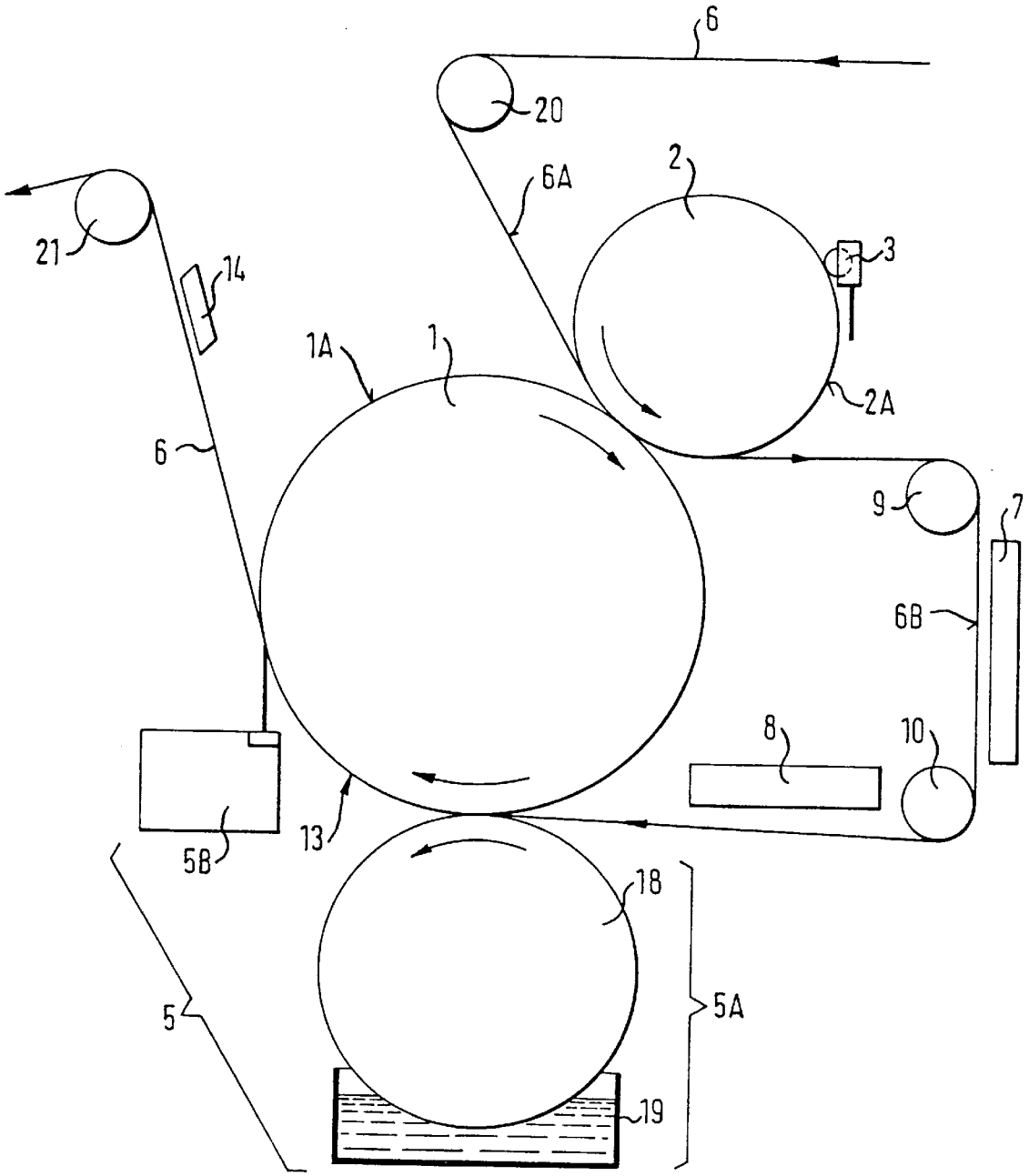
FIG. 9 is a schematic side elevation of a ninth exemplary embodiment of the apparatus according to the invention.

A sixth embodiment shown in FIG. 6 corresponds in its basic structure to the embodiment relative to FIG. 5. Instead of a finish-dosing applicator assembly, however, an applicator assembly is now provided that is divided in a predosing apparatus 5A and a finish-dosing apparatus 5B. Finish-dosing apparatus 5B follows predosing apparatus 5A in the direction of web travel, and both apparatuses 5A, 5B are coordinated with backing roll 1. Material web 6 is in the region of the predosing and finish-dosing apparatuses 5A, 5B carried along an application zone 13 on surface 1A of backing roll 1. Predosing apparatus 5A is indicated as doctor-element/pressure-chamber applicator assembly that applies the medium from a pressure chamber via a doctor element, for example a roll doctor, directly on material web 6. Spaced thereafter, a scraping blade of finish-dosing apparatus 5B strips the surplus of the previously applied coat from material web 6.

In a seventh embodiment (FIG. 7), the doctor-element/pressure-chamber applicator assembly 5A in FIG. 6 is replaced by an open-jet nozzle applicator assembly 5A. Here, the medium to be applied is applied by a nozzle as an open jet, without contact, on material web 6. In an eighth embodiment (FIG. 8), doctor-element/pressure-chamber applicator assembly 5A in FIG. 6 is replaced by a so-called "bent blade" pressure-chamber applicator assembly with an angled doctor bed. In a ninth embodiment (FIG. 9), the doctor element/pressure chamber applicator assembly in FIG. 6 is replaced by a scoop roll applicator assembly 5A. A scoop roll 18 scoops the liquid or pasty medium to be applied out of a reservoir 19 and applies it then with its roll surface directly on material web 6.

In the embodiments according to FIG. 5 through 9, a third applicator assembly 11 may be provided additionally, on the approach side before the first press nip formed between applicator roll 2 and backing roll 1. Such third applicator assembly 11 is in shape and function analogous to the second embodiment in FIG. 2 and the fourth embodiment in FIG. 4. A primer coat applied to web back side 6B with third applicator assembly 11 can at least be predried by dryer 8. A further drying may then be effected by dryer 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for application of at least one coat of at least one coating medium on at least one side of a traveling fiber material web, and for successive application of two coats of the at least one coating medium on a first side of the traveling fiber material web, said apparatus comprising:

a rotating backing roll;

a first rotating applicator roll having a roll surface, said first applicator roll and said backing roll defining a first press nip therebetween;

a first applicator assembly positioned in association with said roll surface for applying a first coating medium to said roll surface, said first applicator assembly and said first applicator roll conjunctively defining a first indirect applicator for applying the first coating medium to the first side of the fiber material web;

a first drying apparatus positioned after said first press nip relative to a direction of travel of the fiber material web, said first drying apparatus positioned in association with the first side of the material web;

a second applicator positioned after said first drying apparatus relative to the direction of travel of the fiber material web, said second applicator also positioned in association with said backing roll whereby the traveling fiber material web travels between said second applicator and said backing roll, said second applicator configured for applying a second coating medium to the first side of the fiber material web; and at least one reversing roll, wherein the fiber material web travels between said first applicator assembly and said second applicator over said at least one reversing roll.

2. The apparatus of claim 1, wherein the traveling material web includes a second side, the third coating medium being applied on said second side of the traveling material web, and further comprising a second drying apparatus positioned after said first press nip relative to the direction of travel of the fiber material web, said second drying apparatus being positioned in association with said second side of the traveling material web.

3. The apparatus of claim 2, further comprising first and second reversing rolls for routing the material web between said first applicator assembly and said second applicator, the traveling material web including a section between said first and second reversing rolls, said first drying apparatus including at least one dryer arranged at said section of the traveling material web, said second drying apparatus including at least one dryer positioned in association with said second side of the traveling material web, said at least one dryer of said second drying apparatus being positioned after said second reversing roll relative to the direction of travel of the fiber material web.

4. The apparatus of claim 3, wherein the said first and second reversing rolls are substantially vertically aligned and said second reversing roll and said second applicator are substantially horizontally aligned.

5. The apparatus of claim 4, further comprising a fourth applicator assembly positioned in association with said outside surface of said backing roll for applying a fourth coating medium on said outside surface of said backing roll, said fourth applicator assembly being positioned before said second applicator relative to the direction of travel of the fiber material web.

6. The apparatus of claim 5, further comprising a third dryer apparatus including at least one dryer positioned after said second applicator relative to the direction of travel of the fiber material web, said third dryer apparatus being positioned in association with said first side of the traveling material web.

7. The apparatus of claim 5, further comprising a third dryer apparatus including at least one dryer positioned after said second applicator relative to the direction of travel of the fiber material web, said third dryer apparatus being positioned in association with said second side of the traveling material web.

8. The apparatus of claim 7, wherein said first, second and third dryer apparatuses comprise infrared dryers.

9. The apparatus of claim 8, wherein said first, second, third and fourth applicator assemblies comprise finish-dosing applicator assemblies.

10. The apparatus of claim 9, wherein each said finish-dosing applicator assembly comprises one of doctor-element/pressure-chamber applicator assemblies and doctor-element/sump applicator assemblies.

11. The apparatus of claim 10, wherein each said doctor-element/pressure-chamber applicator assembly and each said doctor-element/sump applicator assembly includes a doctor element, each said doctor element being one of a profiled roll doctor, smooth roll doctor, doctor bar and doctor blade.

12. The apparatus of claim 11, wherein said first and third applicator assemblies each comprise a predosing apparatus and said second and fourth applicator assemblies each comprise a follow-on finish-dosing apparatus.

13. The apparatus of claim 12, wherein said second applicator assembly comprises a predosing apparatus and a follow-on finish dosing apparatus, said predosing apparatus of said second applicator assembly comprising one of a scoop roll, doctor-element/pressure-chamber applicator assembly and open-jet nozzle applicator assembly.

14. The apparatus of claim 13, wherein said predosing apparatus of said second applicator assembly comprises a doctor-element/pressure-chamber applicator assembly including a doctor-element, said doctor element comprising one of a profiled roll doctor, a smooth roll doctor, a doctor bar and a doctor blade.

15. The apparatus of claim 13, wherein said follow-on finish dosing apparatus of said second applicator assembly comprises one of a doctor blade, doctor bar and smooth roll doctor.

16. An apparatus for successive application of two coats of at least one coating medium on one side of a traveling fiber material web, said apparatus comprising:

a rotating backing roll;

a first rotating applicator roll having a roll surface, said first applicator roll and said backing roll defining a first press nip therebetween;

at least one reversing roll configured for biasing the fiber material web against said first rotating applicator roll;

a first applicator assembly positioned in association with said roll surface for applying a first coating medium to said roll surface, said first applicator assembly and said first applicator roll conjunctively defining a first indirect applicator for applying the first coating medium to a first side of the fiber material web;

a first drying apparatus positioned after said first press nip relative to a direction of travel of the fiber material web, said first drying apparatus positioned in association with the first side of the material web; and a second applicator positioned after said first drying apparatus relative to the direction of travel of the fiber material web, said second applicator also positioned in association with said backing roll whereby the traveling fiber material web travels between said second applicator and said backing roll, said second applicator configured for applying a second coating medium to the first side of the fiber material web.

* * * * *